US011447361B2

(12) United States Patent
Fusar Poli et al.

(10) Patent No.: US 11,447,361 B2
(45) Date of Patent: Sep. 20, 2022

(54) FOLDING APPARATUS FOR A CONTINUOUS WEB

(71) Applicant: GDM S.p.A., Bologna (IT)

(72) Inventors: Aldo Fusar Poli, Offanengo (IT); Marco Rosani, Vailarate (IT); Matteo Piantoni, Albino (IT)

(73) Assignee: GDM S.P.A., Bologna (IT)

( * ) Notice: Subject to any disclaimer, the term of this patent is extended or adjusted under 35 U.S.C. 154(b) by 69 days.

(21) Appl. No.: 17/078,855

(22) Filed: Oct. 23, 2020

(65) Prior Publication Data

US 2021/0122603 A1 Apr. 29, 2021

(30) Foreign Application Priority Data

Oct. 24, 2019 (IT) ..... 102019000019706

(51) Int. Cl.
*B65H 45/22* (2006.01)
*B65H 23/02* (2006.01)
*B65H 23/032* (2006.01)

(52) U.S. Cl.
CPC ..... *B65H 45/22* (2013.01); *B65H 23/0204* (2013.01); *B65H 23/032* (2013.01); *B65H 2301/45* (2013.01); *B65H 2404/222* (2013.01); *B65H 2404/26* (2013.01); *B65H 2406/32* (2013.01)

(58) Field of Classification Search
CPC .. B65H 45/22; B65H 23/032; B65H 23/0204; B65H 2301/45; B65H 2404/222; B65H 2404/26; B65H 2406/32
USPC ..... 270/41
See application file for complete search history.

(56) References Cited

U.S. PATENT DOCUMENTS 4,747,817 A * 5/1988 Newsome ..... B65H 29/6627 198/461.1
5,090,672 A 2/1992 Ballestrazzi et al.
6,024,684 A * 2/2000 Maylander ..... B41F 13/58 270/41
6,712,749 B1 * 3/2004 Michalik ..... B65H 45/221 270/41
7,066,368 B1 * 6/2006 Ruckmann ..... B65H 45/223 270/32

(Continued)

FOREIGN PATENT DOCUMENTS

JP 2003038566 A 2/2003

OTHER PUBLICATIONS

Italian Search Report dated Jun. 29, 2020 from counterpart Italian App No. IT 201900019706.

*Primary Examiner* — Leslie A Nicholson, III
(74) *Attorney, Agent, or Firm* — Shuttleworth & Ingersoll, PLC; Timothy Klima

(57) ABSTRACT

A folding apparatus for a continuous web being fed in a plant for the production of hygienic absorbent articles and intended to be folded into a "V" or "U" shape in a first and in a second longitudinal portion according to a longitudinal folding line parallel to a feeding line of the continuous web comprises a folding section including a first and a second power-driven, movable suction belt and an adjusting system for adjusting a relative position of the longitudinal edges of the continuous web once it has been folded; the adjusting system is configured to adjust the position of the first belt and/or of the second belt depending on at least a first information sent by the first sensor to the computerised control unit.

16 Claims, 4 Drawing Sheets

(56) References Cited

U.S. PATENT DOCUMENTS

| | | | |
|---|---|---|---|
| 2010/0168708 | A1 | 7/2010 | Umebayashi et al. |
| 2016/0228303 | A1 | 8/2016 | Wada |

* cited by examiner

FOLDING APPARATUS FOR A CONTINUOUS WEB

This application claims priority to Italian Patent Application 102019000019706 filed Oct. 24, 2019, the entirety of which is incorporated by reference herein.

This description relates to a folder or folding apparatus for a continuous web and in particular an apparatus for folding in two a continuous composite web intended for making products of the absorbent hygiene article type, for example nappies or incontinence pants.

During the production of nappies or incontinence pants, for example those wearable like pants, a semi-finished product, in the form of a composite web, usually comprising multiple components which have been assembled, is folded in two along a longitudinal folding line.

In that case, what is always wanted is for the longitudinal edges of the web, which following folding are superposed, to be in a precise position relative to each other, for example aligned.

In this context, the technical purpose which forms the basis of this description is to propose a folding apparatus for a composite web which allows the longitudinal edges of a web, once the web has been folded in two, to be positioned in a predetermined position relative to each other, for example aligned.

Different types of composite webs, since they are manufactured from different materials in variable proportions, do not react to the folding action in the same way.

Composite webs react differently to the folding action depending on how soft or rigid they are; thus, a specific folding treatment, if applied without adjusting to the different types of web, could lead to misalignment downstream of the folding system, causing quality problems in the finished product.

An aim of this description is to propose a folding apparatus for a web which is being fed along a plant for the production or manufacture of absorbent hygiene articles, which is reliable for positioning the longitudinal edges of the web relative to each other, once the web has been folded.

Another aim of this description is to propose a folding apparatus for a web which is being fed along a plant for the production or manufacture of absorbent hygiene articles, which adapts quickly and dynamically to the properties of the composite web, so as to ensure uniformity of treatment and quality of the finished product.

At least the aims specified are substantially achieved by a folding apparatus according to one or more of the appended claims.

According to one aspect of the description, the description relates to a folding apparatus for a continuous web being fed in a plant for manufacturing absorbent hygiene articles.

The continuous web is preferably folded in a transversal direction according to a longitudinal folding line parallel to a web feeding line.

According to one aspect of the description the apparatus is also preferably equipped for positioning the longitudinal edges of the web in a predetermined position relative to each other, once the web has been folded.

According to one aspect of the description, the folding apparatus comprises a folding section where the web is folded in two according to a longitudinal folding line.

According to one aspect of the description, the web is folded, for example, in such a way that, at the end of the folding operation, the opposite longitudinal edges of the web are superposed on each other.

The folding apparatus according to this description comprises a folding section where folding of the web takes place.

Folding can occur, in use, because the web passes through the folding section.

According to one aspect of the description, the folding apparatus comprises a feeding system for the continuous web, preferably folded, located downstream of the folding section according to the web feeding direction.

According to one aspect of the description, the folding section comprises a first movable suction belt and a second movable suction belt, disposed on opposite sides of a plane containing the folding line of the continuous web.

The web being fed along the folding section and in contact with the belts thus passes from a flat, open configuration, to a transversely folded configuration, with two longitudinal flaps side by side and separated by the folding line.

Folding of the web is preferably guided by the belts from start to finish and is therefore extremely precise.

Preferably, the machine comprises a web contact unit to contribute to defining the folding line.

The contact unit lies in a plane in which the folding line is at least partly defined.

The contact unit lies in a plane at least partly containing the folding line and terminates at the bottom at the folding line itself.

According to one aspect of the description, the contact unit comprises a motor-driven belt comprising a branch movable in the web feeding direction and defining both the contact for the web and the folding line.

The belt of the contact unit contributes to feeding the web in the folding section.

According to one aspect of the description, the folding section further comprises a pair of guides adapted to cooperate with the movable suction belts to make the operations of folding the continuous web even more precise.

Each guide has a sliding surface defining a folding surface along which one of the two longitudinal portions of the continuous web, divided by the folding line, is made to slide.

Preferably, the sliding surfaces have a substantially flat and horizontal infeed section and a substantially flat and vertical outfeed section.

The sliding surfaces converge from the infeed section towards the outfeed section.

Thanks to this structure, the web is in the folded configuration when it exits the guides.

According to one aspect of the description, the position of the suction belts is adjustable rotationally around an axis of rotation which is transversal, for example perpendicular, to the feeding direction, or translationally along the feeding direction, or both rotationally and translationally.

Adjustment of the position of the movable suction belts can be performed on only one of the suction belts or on both, independently for each of the belts or on both of them as one which thus move as a single block.

The position of the contact unit is also adjustable rotationally around an axis of rotation which is transversal, for example perpendicular, to the feeding direction, or translationally along the feeding direction, or both rotationally and translationally.

According to one aspect of the description, the guides are integral with the movable suction belts and are therefore adjusted together with the belts.

According to another aspect, the guides are independent of the suction belts and their position is adjustable separately around an axis of rotation which is transversal, for example perpendicular, to the feeding direction, or translationally along the feeding direction, or both rotationally and translationally.

Adjustment of the position of the guides can be performed on only one of the guides or on both, independently for each of the guides or on both of them as one which thus move as a single block.

The position of the movable components described above is preferably controlled and adjusted by feedback through an adjusting system.

The purpose of the adjusting system is to check the position of the longitudinal edges of the web relative to each other after the web has been folded so as to ensure that the edges are superposed to the right extent and also to adjust the position of the movable components of the folding apparatus so as to ensure optimum folding which in turn ensures that the end product is of good quality.

According to an aspect of the description, the adjusting system comprises a first position sensor, located downstream of the folding section, which checks the position of the edges of the web relative to each other after the web has been folded.

The information obtained from the first sensor is then sent to a computerised control unit which also forms part of the adjusting system.

According to an aspect of the description, the adjusting system comprises at least one actuator configured to receive control signals from the computerised control unit in order to adjust the position of one or more of the movable components of the folding system, be they the suction belts, the guides or the contact element.

The control signals sent by the computerised unit to the at least one actuator are processed by the computerised unit as a function of the information received from the first sensor.

According to an aspect of the description, the adjusting system comprises a second sensor, located upstream of the folding section and configured to check the position of the longitudinal edges of the web when the web is still laid out flat, before being folded.

In this configuration, the computerised unit uses the information from the second sensor, and, if necessary, that from the first sensor, to adjust the position of the movable components of the folding section, be they the suction belts, the guides or the contact element.

Further features and advantages of the folding apparatus according to this description are more apparent in the non-limiting description of an embodiment of it, illustrated in the accompanying drawings, in which.

With reference to the accompanying drawings, the numeral 1 denotes a folding apparatus for a continuous web 100 being fed in a plant for the production of absorbent hygiene articles which is only partly illustrated.

The web 100 is intended to be folded in two along a longitudinal folding line L parallel, at least partly, to a feeding line D of the continuous web.

The web 100 is for example a composite web comprising a pair of lateral strips which extend along the longitudinal line of the self-same web 100 and are interconnected, for example, by absorbent pads extending along the transversal line of the web.

The web 100 is for example used to form absorbent articles of the type called "pants"; for simplicity, in the accompanying drawings, the web 100 is illustrated very schematically as a continuous web consisting of a single strip of composite material.

Preferably, the web 100 is folded in the folding apparatus 1 in such a way that its longitudinal edges 100*a*, 100*b* are placed in a predetermined position relative to each other, for example substantially superposed downstream of the folding apparatus 1.

It should be noticed that, for greater clarity, in the examples illustrated the folded web 100 is shown with the edges 100*a*, 100*b* slightly spaced from each other at the end of folding.

The edges 100*a* and 100*b* may be substantially superposed also thanks to the variable thickness of the web 100.

The folding apparatus 1 comprises a folding section 2 and, preferably, a feeding system, not illustrated, for feeding the continuous web 100 which is, at least partly, located downstream of the folding section 2 according to a feeding direction V of the web 100.

The feeding system comprises, for example, opposing rollers, not illustrated, which are substantially known and which feed or contribute to the feeding of, the web 100 along the plant for the production of absorbent articles.

The feeding system is not necessarily part of the folding apparatus 1, may be located at other positions along the plant and is used, for folding purposes, to make the web 100 pass through the section 2.

During its movement along the line D in the direction V, the web 100 is folded in a transversal direction relative to its flat configuration, preferably into a "U" or "V" shape, that is to say, along the folding line L.

Figure 1:
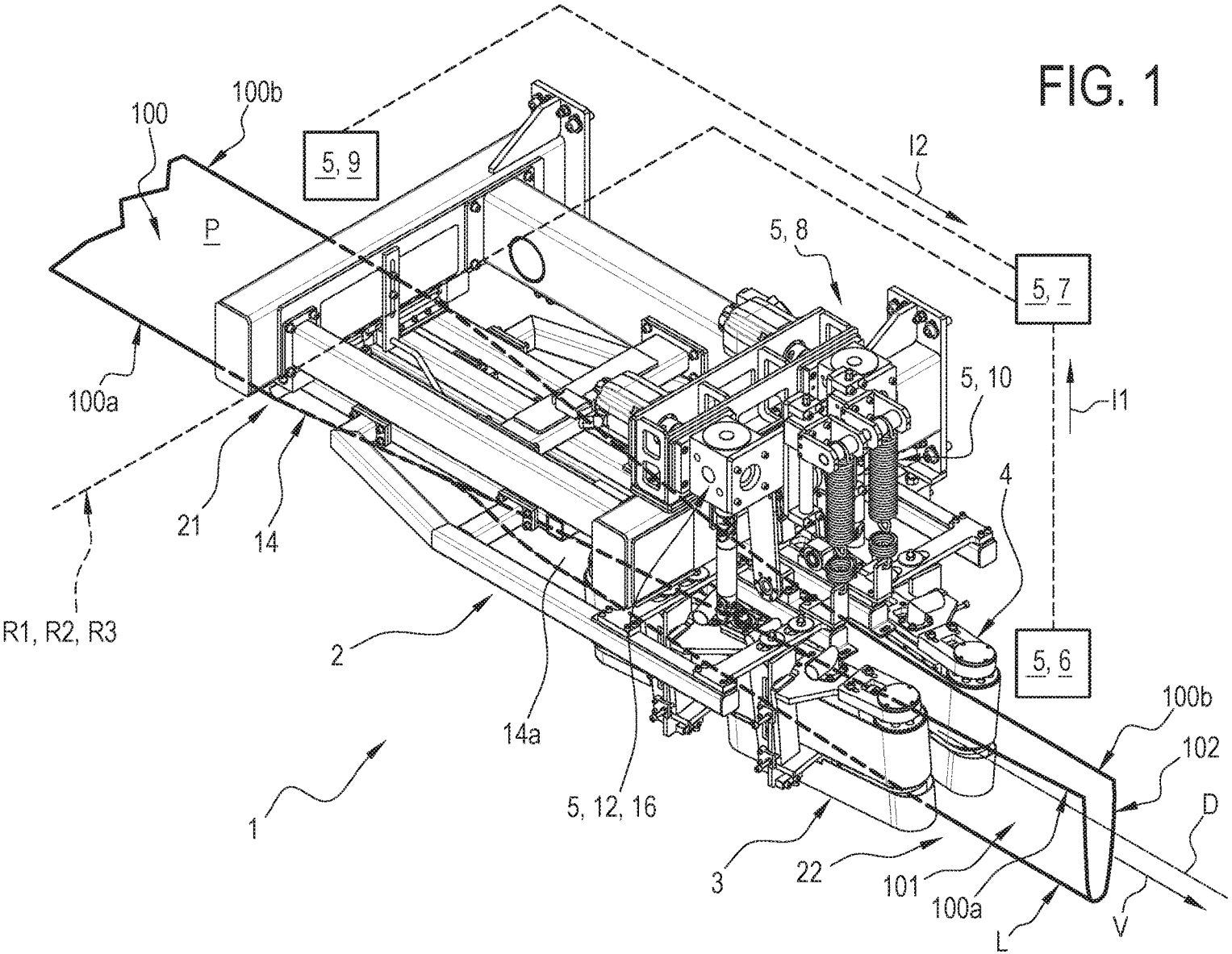
FIG. 1 illustrates the folding apparatus according to this description in a schematic perspective view partly in blocks and with some parts cut away for greater clarity.

With reference to FIG. 1, the web 100 has a first portion 101 and a second portion 102, which are respectively delimited by the folding line L and a first edge 100*a* and by the folding line L and a second edge 100*b*.

The first and second portions 101, 102 are easily identifiable considering the folded web 100 where the portions 101 and 102 are inclined to each other at an angle to form a V or U shape and meet at the folding line L.

The folding section 2 comprises an infeed section 21 for the web 100, where the web 100 is not folded.

In other words, at the infeed section 21, the first and second portions of the web 100 are practically coplanar and lie in a positioning plane P of the web 100 upstream of the folding section 2.

The folding section 2 comprises an outfeed section 22, located downstream of the infeed section 21 according to a direction V of the feeding line D of the web 100.

At the outfeed section 22, the web 100 is folded into the shape of a V or U—that is to say, with the first portion 101 and the second portion 102 inclined at an angle to each other.

During folding operations, the first portion 101 and the second portion 102 are each rotated through 90° almost mirror symmetrically about the folding line L so that at the outfeed section 22, the portions 101, 102 are not parallel to, and preferably at right angles to, the positioning plane of the web 100 upstream of the folding section 2.

More specifically, at the outfeed section 22, the first portion 101 and the second portion 102 lie in planes P1 and P2, respectively, preferably at right angles to the plane P.

Figure 2:
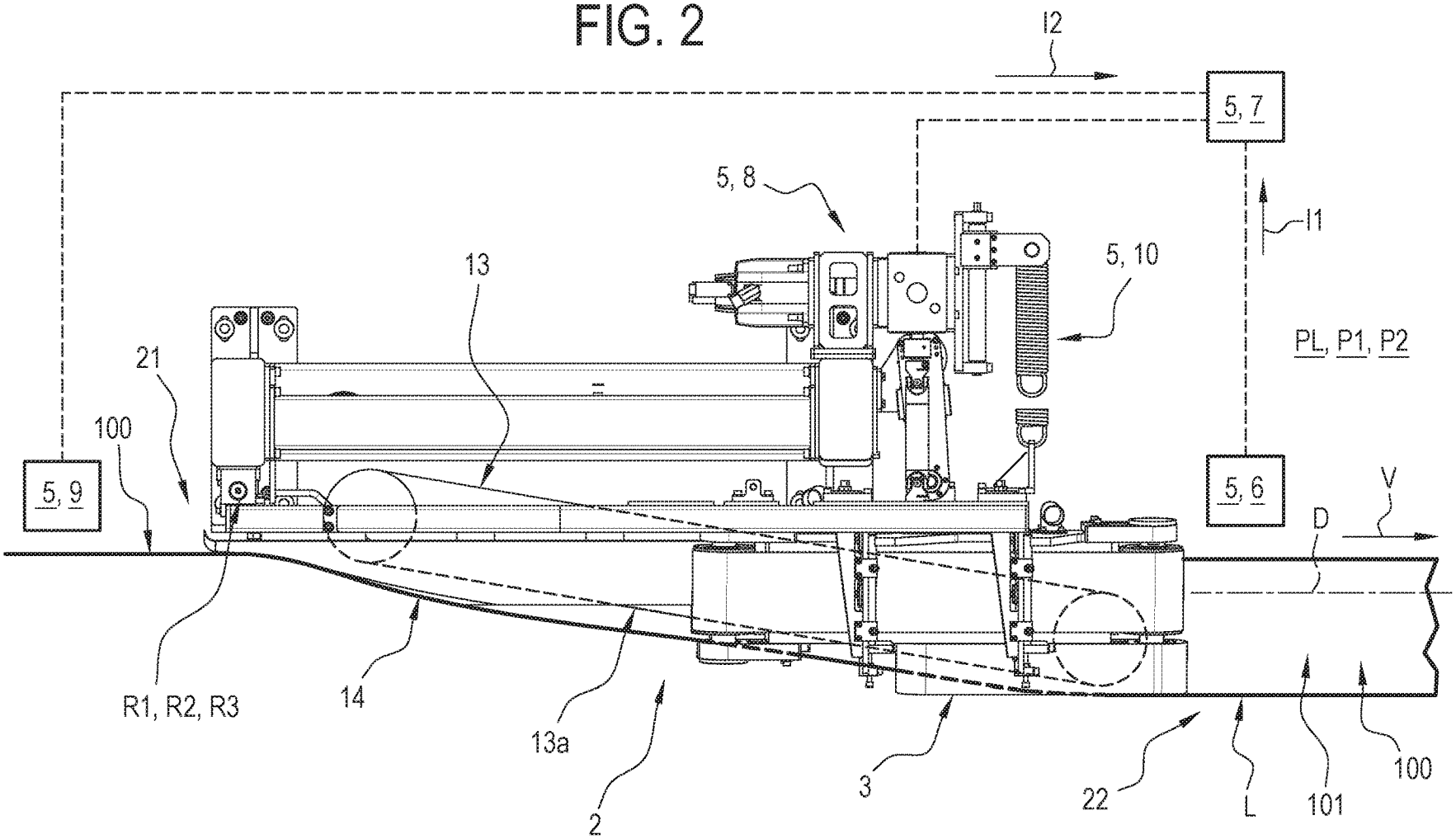
FIG. 2 illustrates the folding apparatus of FIG. 1 in a schematic side view, partly in blocks and with some parts cut away for greater clarity.
Figure 3:
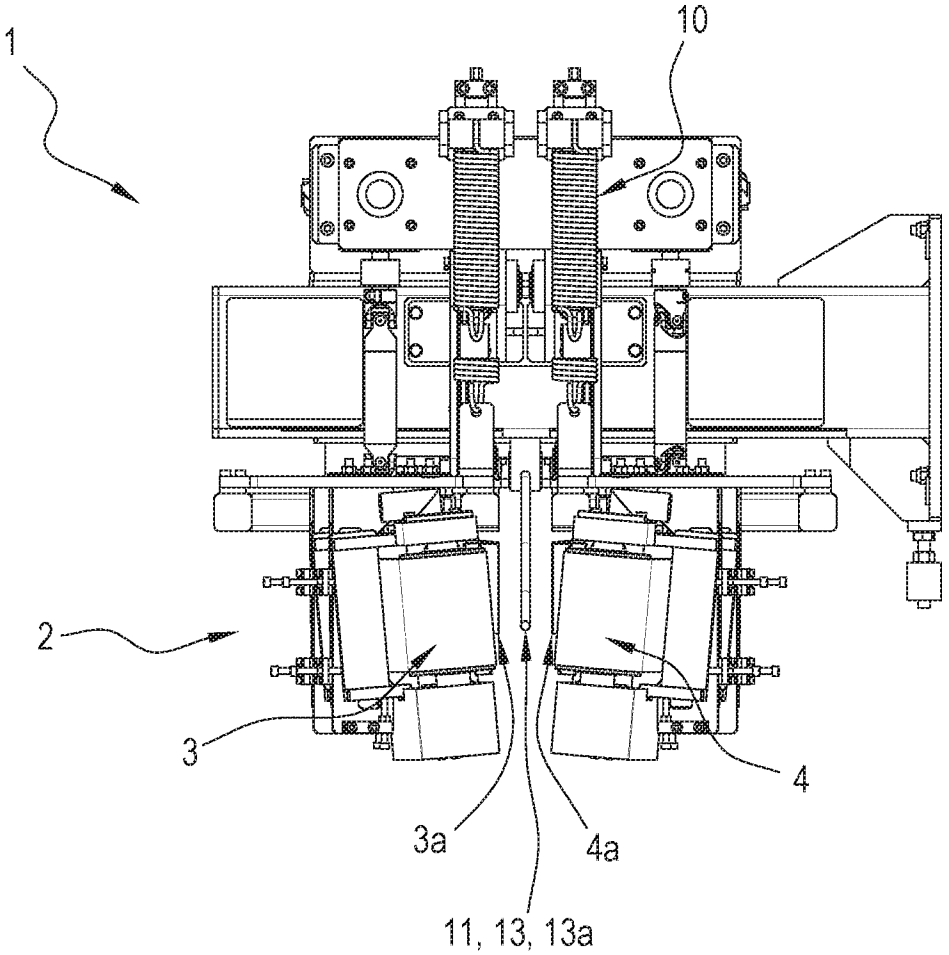
FIG. 3 illustrates the folding apparatus of FIG. 1, in a schematic front view, with some parts cut away for better clarity.

In the embodiment of FIG. 2, the planes P1 and P2, at the outfeed section 22, are shown as being parallel (coincident from the viewing point of the drawing) to the positioning plane PL of the folding line L and thus at right angles to the positioning plane P of the web 100 upstream of the folding section 2.

In other embodiments, the planes P1 and P2 may be inclined to the plane PL and preferably disposed mirror symmetrically about the plane PL.

The planes P1 and P2 preferably converge in the feeding direction V of the web 100.

As illustrated, the section 2 comprises a first suction belt 3, connected to a suction system not illustrated.

The first suction belt 3 comprises at least a first stretch 3*a* movable in a first feeding direction Va of the first edge 100*a*.

The first stretch 3*a* is configured to entrain the first portion 101 of the web 100.

During such entrainment, the position of the first belt 3, specifically at the first stretch 3*a* thereof, causes the first portion 101 to fold until reaching a total folding angle of nearly 90° before moving away from the first stretch 3*a*.

The first belt 3 is of substantially known type, looped around at least two rollers, at least one of which is motor-driven.

Figure 4:
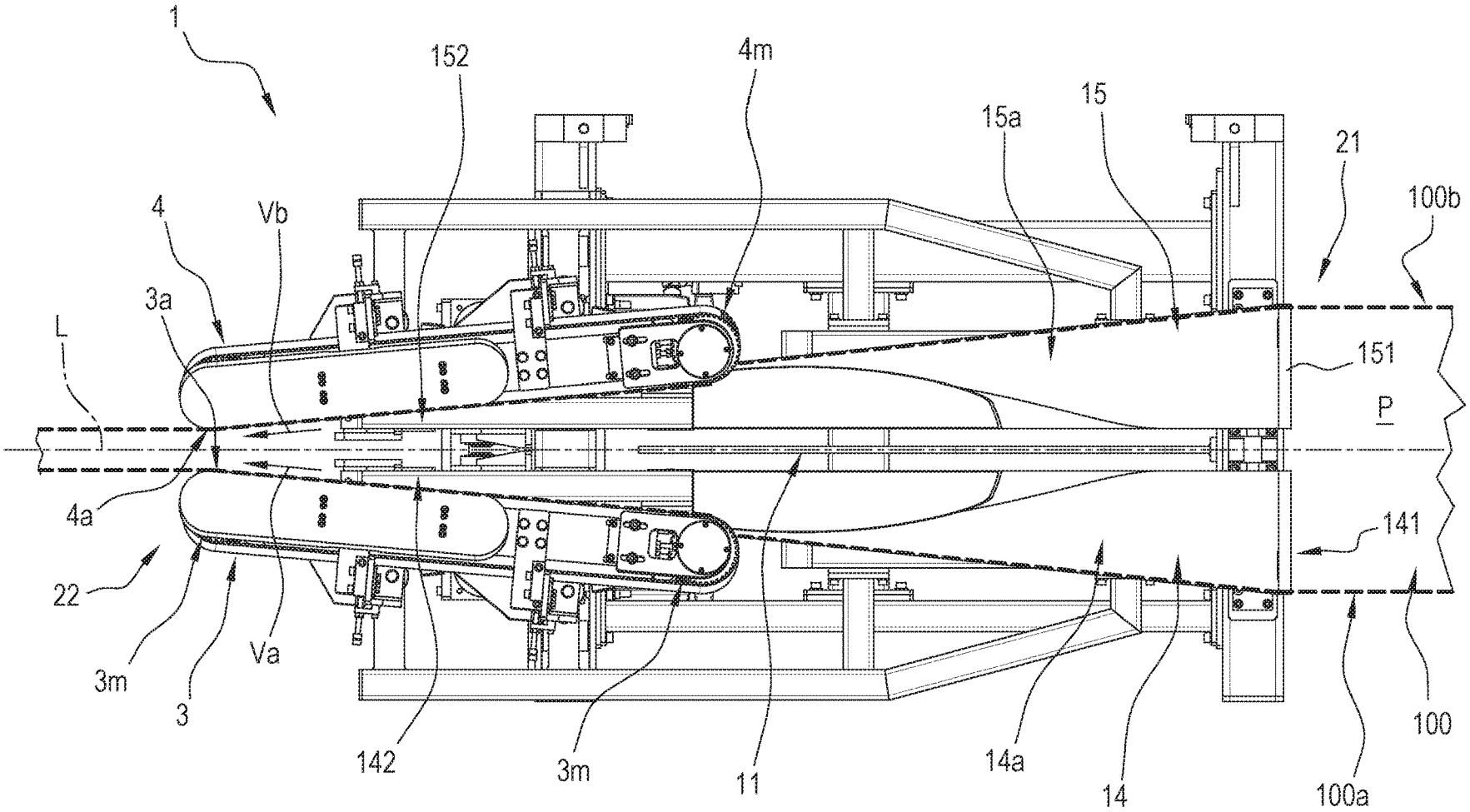
FIG. 4 is a bottom plan view of the folding apparatus of FIG. 1.

A first movement system 3*m* for moving the first belt 3 is schematically represented in FIG. 4, and comprises two rollers, disposed at the two ends of the first belt along the feeding line D of the web 100.

Also as illustrated, the section 2 comprises a second suction belt 4, connected to a suction system not illustrated.

The second suction belt 4 comprises at least a second stretch 4*a* movable in a second feeding direction Vb of the second edge 100*b*.

The second stretch 4*a* is configured to entrain the second portion 102 of the web 100.

During such entrainment, the position of the second belt 4, specifically at the second stretch 4*a* thereof, causes the second portion 102 to fold until reaching a total folding angle of nearly 90° before moving away from the second stretch 4*a*.

The second belt 4 is of substantially known type, looped around at least two rollers, at least one of which is motor-driven.

A second movement system 4*m* for moving the second belt 4 is schematically represented in FIG. 4, and comprises two rollers, disposed at the two ends of the second belt along the feeding line D of the web 100.

The first belt 3 and the second belt 4 are disposed on opposite sides of a positioning plane PL of the folding line L, at right angles to the positioning plane P of the web 100 upstream of the folding section 2.

The first and the second portion 101, 102, undergo respective folding operations in a practically mirror symmetrical manner and are entrained by the first stretch 3*a* and second stretch 4*a*.

According to an aspect of this description, the first and second belts 3, 4 are adjustable in position: that is to say, their positions can be modified by suitable movement systems.

In an embodiment, the adjustment may involve only one between the first belt 3 and the second belt 4, so the other of the two remains fixed during adjustment operations.

In another embodiment, both of the belts are adjustable in position and the adjustment can be performed independently for the first belt 3 and the second belt 4.

In yet another embodiment, the first belt 3 and the second belt 4 behave as a single block and their positions are adjusted simultaneously in the same way.

In the embodiment illustrated in FIG. 1, the first and the second belt 3, 4 are movable in rotation about a first axis of rotation R1, transverse—specifically at right angles to—the feeding line D of the web 100.

In other variant embodiments, the first belt 3 and/or the second belt 4 are movable translationally along the feeding line D of the continuous web. Preferably, the first belt 3 and/or the second belt 4 are movable both rotationally about the first axis R1 and translationally along the feeding line D.

To assist the first and the second belt 3, 4 in the folding operations, the folding section 2 preferably comprises a contact unit 11.

The contact unit 11 extends along the feeding line D of the continuous web and contributes to at least partly defining the folding line L.

Preferably, the unit 11 lies in the positioning plane PL of the folding line L, at right angles to the positioning plane P of the web 100 upstream of the folding section 2.

In other words, the first portion 101 and the second portion 102 passing through the section 2 remain substantially divided by the contact unit 11.

In a first embodiment, illustrated in FIG. 4, the contact unit 11 is a single part, preferably metallic, configured to better define the folding line L.

In an alternative embodiment, illustrated schematically in FIG. 2, the contact unit 11 comprises a third movable belt 13.

The third belt 13 is of the substantially known type, looped around at least two rollers one of which is motor-driven.

The third belt 13 comprises a branch 13*a* movable in the feeding direction V of the web 100 located at the folding line L which is at least partly defined by the self-same branch 13*a*.

In the operations of folding the web 100, the third belt 13 thus cooperates with the first belt 3 and second belt 4, helping them to better define the folding line while the two belts fold the portions 101 and 102 of the web 100.

By means of its movable branch 13*a*, the third belt 13 facilitates feeding of the web 100 in the folding section 2.

Preferably, the contact unit 11 is adjustable in position: that is to say, its position can be modified by suitable movement systems.

In the embodiment illustrated in FIG. 1, the contact unit 11 is movable in rotation about a second axis of rotation R2, transverse—specifically at right angles to—the feeding line D of the web 100.

Preferably, the second axis of rotation R2 coincides with the first axis of rotation R1.

In other variant embodiments, the contact unit 11 is movable translationally along the feeding line D of the continuous web.

Preferably, the contact unit 11 is movable both rotationally about the second axis R2 and translationally along the feeding line D.

In another embodiment, the contact unit 11 moves as one with at least one between the first belt 3 or the second belt 4, with which it forms a single block.

To make the operations of folding the web 100 even easier and more precise, the folding section 2 preferably comprises a first guide 14 and a second guide 15.

Preferably, the first guide 14 and the second guide 15 are disposed on opposite sides of the positioning plane PL of the folding line and extend predominantly along the feeding line D of the web 100.

The guides 14 and 15 have a first sliding surface 14*a* and a second sliding surface 15*a* for the continuous web.

In the embodiment illustrated in FIG. 1, the first portion 101 at least partly slides in contact with the first surface 14*a* whilst the second portion 102 at least partly slides in contact with the surface 15*a* along the section 2.

In a configuration illustrated, the layout of the folding section 2 is such that the guides 14 and 15 are above the web 100, relative to the reference provided by the axis Y when it is not folded or between the two portions 101, 102 of the web when it is folded.

In this configuration, the first portion 101, as it slides along the section 2, is interposed between the first belt 3 and the first surface 14*a*, while the second portion 102 is interposed between the second belt 4 and the second surface 15*a*.

In an alternative configuration, the layout of the folding section 2 is such that the guides 14 and 15 are below the web 100, relative to the reference provided by the axis Y when it is not folded or between the two portions 101, 102 of the web when it is folded.

In an embodiment, illustrated in the accompanying drawings, the first sliding surface 14*a* of the first guide 14 extends in a helical fashion and has an infeed section 141 and an outfeed section 142 which is downstream of the infeed section in the feeding direction V of the web 100.

As illustrated, the infeed section 141 of the surface 14*a* lies in a first plane which is substantially parallel to the positioning plane P of the web 100 upstream of the folding section 2.

The outfeed section 142 of the surface 14*a* lies preferably in the plane P1—that is, in a plane which is transverse to the plane P in order to fold the first portion 101 of the web 100.

In particular, the surface 14*a* shaped in this way causes a substantially 90° rotation of the first portion 101 about the folding line L.

Similarly to what is described for the first surface 14*a*, the second sliding surface 15*a* of the second guide 15 extends in a helical fashion and has an infeed section 151 and an outfeed section 152 which is downstream of the infeed section in the feeding direction V of the web 100.

As illustrated, the infeed section 151 of the surface 15*a* lies in a first plane which is substantially parallel to the positioning plane P of the web 100 upstream of the folding section 2.

The outfeed section 152 of the surface 15*a* lies preferably in the plane P2—that is, in a plane which is transverse to the plane P in order to fold the second portion 102 of the web 100.

In particular, the surface 15*a* shaped in this way causes a substantially 90° rotation of the second portion 102 about the folding line L.

The surfaces 14*a*, 15*a* converge at the respective outfeed sections 142, 152 in such a way that downstream of the section 2 the web 100 is folded.

In an alternative embodiment not illustrated, the first guide 14 and the second guide 15 are composed of two or more stretches, which are not physically connected to each other, in order to accompany the web 100 during folding operations.

In an example embodiment not illustrated, the first guide 14 and the second guide 15 are composed of two stretches: a first stretch, at the infeed sections 141, 151, lying in a plane which is substantially parallel to the positioning plane P of the web 100 upstream of the folding section 2, and a second stretch, at the outfeed sections 142, 152, lying in a plane which is substantially perpendicular to the positioning plane P of the web 100 upstream of the folding section 2.

According to an aspect of this description, the first guide 14 and/or the second guide 15 are adjustable in position: that is to say, their positions can be modified by suitable movement systems which are described below.

In an embodiment, the adjustment may involve only one between the first guide 14 and the second guide 15, so the other of the two remains fixed during adjustment operations.

In another embodiment, both of the guides 14, 15 are adjustable in position and the adjustment can be performed independently for the first guide 14 and the second guide 15.

In yet another embodiment, the first guide 14 and the second guide 15 behave as a single block and their positions are adjusted simultaneously in the same way.

In the embodiment illustrated in FIG. 1, the first and the second guide 14, 15 are movable in rotation about a third axis of rotation R3, transverse—specifically at right angles to—the feeding line D of the web 100.

Preferably, the third axis of rotation R3 coincides with the first axis of rotation R1.

In other variant embodiments, the first guide 14 and/or the second guide 15 are movable translationally along the feeding line D of the continuous web.

Preferably, the first and the second guide 14, 15 are movable both rotationally about the third axis R3 and translationally along the feeding line D.

In order to adjust the relative position of the edges 100*a*, 100*b* of the web 100 once the web is folded, the folding apparatus 1 comprises a respective adjusting system 5, which is illustrated partly schematically in FIGS. 1 and 2.

More specifically, in order to obtain a quality finished product, it is important that the edges 100*a*, 100*b* of the web 100 be superposed and both abutted against each other at the same level relative to a vertical axis Y of the folding apparatus 1.

The adjusting system 5 comprises a first sensor 6, located downstream of the folding section 2 and configured to detect the position of the edges 100*a*, 100*b* of the web 100 after folding.

Detecting the position of the edges 100*a*, 100*b* may comprise detecting the absolute position of one of the edges 100*a*, 100*b* (and inferring the position of the other edge according to a model representing the continuous web 100) or detecting the absolute position of both edges 100*a*, 100*b*, or even detecting a relative position between the edges 100*a*, 100*b*.

Preferably, the first sensor 6 is an optical sensor.

Still more preferably, the first sensor 6 is an optical fork sensor.

The adjusting system 5 also comprises at least one first actuator 8, operatively connected to the first and the second belt 3, 4.

The first actuator 8 is configured to adjust the position of the first belt 3 and/or of the second belt 4.

Preferably, when the first and the second belt 3, 4 are movable only in rotation about the first axis of rotation R1 between a maximum level position and a minimum level position, the first actuator 8 is positioned vertically—that is, parallel to the vertical axis Y of the folding apparatus 1.

Advantageously, positioning the first actuator 8 in this way means that the force applied by the first actuator does not need to be broken down into a vertical working component which is parallel to the vertical axis Y, and a horizontal component which is perpendicular to the vertical axis Y.

In the embodiments in which one between the first belt 3 or the second belt 4 is movable, only one actuator 8 is necessary to adjust the movable belt, which is either the first belt 3 or the second belt 4.

In the embodiments in which the first belt 3 and the second belt 4 are movable as one, a single first actuator 8 is sufficient.

In the embodiments in which the two belts 3, 4 are adjustable independently of each other, at least two first actuators 8 are preferably provided, disposed on opposite sides of the plane PL at right angles to the positioning plane P of the web 100 upstream of the folding section 2 and each responsible for adjusting one of the belts.

The adjusting system also comprises a computerised control unit 7, in communication with the first sensor 6 and with the first actuator 8.

The computerised unit 7 is configured to receive from the first sensor 6 a first information I1 relating to the position of the longitudinal edges 100*a*, 100*b* of the folded web 100 downstream of the folding section 2.

Based on at least the first information I1 received from the first sensor 6, the computerised unit 7 processes a control signal for the first actuator 8 which, if necessary, modifies the positions of the belts 3, 4.

Using this feedback mechanism, the adjusting system 5 adjusts, through the first actuator 8, the position of the first belt 3 and/or of the second belt 4 as a function at least of the first information I1.

Advantageously, the feedback adjusting system ensures that the edges 100*a*, 100*b* downstream of the folding section 2 are optimally aligned, thereby guaranteeing a finished product of satisfactory quality.

Preferably, the adjusting system 5 comprises at least one second sensor 9, located upstream of the folding section 2 in the feeding direction V of the web.

The second sensor 9 is configured to detect the position of the edges 100*a*, 100*b* of the web 100 when the web has not yet been folded—that is, when it is upstream of the folding section 2 in the feeding direction V of the web.

Preferably, the second sensor 9 is an optical sensor.

Still more preferably, the second sensor 9 is an optical fork sensor.

The second sensor 9 is in communication with the computerised unit 7 and is configured to send to the computerised unit 7 a second information I2 relating to the position of the longitudinal edges 100*a*, 100*b* of the web 100 when it has not yet been folded.

Detecting the position of the edges 100*a*, 100*b* may comprise detecting the absolute position of one of the edges 100*a*, 100*b* (and inferring the position of the other edge according to a model representing the continuous web 100) or detecting the absolute position of both edges 100*a*, 100*b*, or even detecting a relative position between the edges 100*a*, 100*b*.

More specifically, the computerised unit 7 compares the position of the longitudinal edges 100*a*, 100*b* detected by the second sensor 9 with a nominal position of the edges under optimum conditions.

Preferably, the computerised unit 7 processes the second information I2, combining it at least with the first information I1, to generate control signals for the movable components of the folding section 2.

More specifically, the computerised unit 7 generates control signals for the first actuator 8 as a function at least of the first and the second information I1 and I2.

Thus, the adjusting system 5 adjusts the position of the first belt 3 and/or of the second belt 4 by feedback as a function at least of the first and the second information I1 and I2.

In an embodiment comprising a contact element 11 whose position is adjustable, the adjusting system 5 comprises a second actuator 12, operatively connected to the contact element 11 and in communication with the computerised unit 7.

The second actuator 12 is configured to adjust the position of the contact element 11.

More specifically, the second actuator 12 is configured to receive from the computerised unit 7 a control signal containing information regarding positional adjustment to be performed, if necessary, on the contact element 11.

This control signal is processed and generated by the computerized unit 7 preferably as a function at least of the first information I1 or the second information I2.

Still more preferably, this control signal is processed and generated by the computerized unit 7 preferably as a function at least of the first information I1 and the second information I2.

Preferably, when the contact element 11 is movable only in rotation about the second axis of rotation R2 between a maximum level position and a minimum level position, the second actuator 12 is positioned vertically—that is, parallel to the vertical axis Y of the folding apparatus 1.

Advantageously, positioning the second actuator 12 in this way means that the force applied by the second actuator does not need to be broken down into a vertical working component which is parallel to the vertical axis Y, and a horizontal component which is perpendicular to the vertical axis Y.

In the embodiments in which the folding section 2 comprises guides 14, 15 which are integral with the belts 3, 4, respectively, the guides are adjusted in position at the same time as the belts, preferably by means of the at least one first actuator 8.

In an embodiment comprising a first guide 14 and/or a second guide 15 adjustable in position independently of the belts 3, 4, the adjusting system 5 comprises at least a third actuator 16 operatively connected to the first and the second guide 14, 15 and in communication with the computerised unit 7.

The third actuator 16 is configured to adjust the position of the first guide 14 and/or of the second guide 15.

More specifically, the third actuator 16 is configured to receive from the computerised unit 7 a control signal containing information regarding positional adjustment to be performed, if necessary, on the guides 14, 15.

This control signal is processed and generated by the computerized unit 7 preferably as a function at least of the first information I1 or the second information I2.

Still more preferably, this control signal is processed and generated by the computerized unit 7 preferably as a function at least of the first information I1 and the second information I2.

Preferably, when the first and the second guide 14, 15 are movable only in rotation about the third axis of rotation R3 between a maximum level position and a minimum level position, the third actuator 16 is positioned vertically—that is, parallel to the vertical axis Y of the folding apparatus 1.

Advantageously, positioning the third actuator 16 in this way means that the force applied by the third actuator does not need to be broken down into a vertical working component which is parallel to the vertical axis Y, and a horizontal component which is perpendicular to the vertical axis Y.

In alternative embodiments in which the first guide 14 and the second guide 15 are adjustable in position independently of each other, the adjusting system 5 comprises two third actuators 16 configured to move the corresponding guide independently of the other actuator.

According to another aspect of this invention, the adjusting system 5 comprises at least one suspension element 10 configured for counterbalancing the weight of at least part of the folding section 2.

Preferably, the suspension element 10 comprises a spring which, in its condition of equilibrium, is adapted to keep at least part of the folding section at a predetermined, stable level.

Still more preferably, the spring is a gas spring.

Advantageously, the suspension element 10 allows the actuators 8, 12, 16 of the adjusting system 5, to manage only the position adjustment operations without having to perform the function of keeping the folding section 2 in position.

In this configuration, the actuators of the adjusting system 5 need only oppose the spring force of the suspension element 10 which advantageously makes the adjusting system more efficient in dynamic terms.

In the example illustrated, the adjusting system comprises two suspension elements represented as helical springs, acting respectively on the first belt 3 and on the second belt 4.

The suspension elements each have a first end which is fixed relative to the at least one actuator, and a second end which is fixed relative to the corresponding belt.

The suspension element has two operating conditions: a shortened condition, corresponding substantially to the maximum level position of the first and/or the second belt, and an elongated condition, corresponding to the minimum level position of the first and/or the second belt.

Also defined according to this description is a folding method for a continuous web 100 being fed in a plant for the production of hygienic absorbent articles and intended to be folded into a "V" or "U" shape in a first and in a second longitudinal portion 101, 102 along a longitudinal folding line L parallel to a feeding line D of the web 100.

The method comprises the following steps, in sequence:

preparing a folding section 2 comprising an infeed section 21, where the continuous web 100 is not folded, an outfeed section 22, positioned downstream of the infeed section 21 according to a continuous web feeding direction V, where the continuous web 100 is folded into a "V" or "U" shape and has the first portion 101 and the second portion 102 set at an angle to each other; the folding section 2 also comprising at least one first suction belt 3 and one second suction belt 2, both with adjustable position and configured for feeding, respectively, the first and the second portion 101, 102 of the web 100;

feeding the continuous web 100 along the feeding line D in the feeding direction V of the web itself;

first detection of the position of a first edge 100*a* and of a second edge 100*b* of the unfolded web 100 upstream of the folding station 2 according to the feeding direction V of the web 100;

folding of the web 100 through the folding section 2;

second detection of the position of the first edge 100*a* and of the second edge 100*b* of the folded web 100 downstream of the folding station 2 according to the feeding direction V of the continuous web 100;

adjusting the position of the first belt 3 and of the second belt 4 by feedback as a function of the results of the step of first detection and the step of second detection.

Advantageously, adjusting by feedback as a function of the results of the steps of first detection and of second detection allows positioning the components of the folding section 2 which are adjustable in position, including the first belt 3 and the second belt 4, in such a way that folding is carried out in optimum manner to guarantee a finished product of optimum quality.

In alternative embodiments, the folding section 2 may, in addition to the first belt 3 and the second belt 4, comprise other components which are adjustable in position, including a contact element 11 and a first and a second guide 14, 15.

The invention claimed is:

1. A folding apparatus for folding a continuous web, being fed in a plant for production of hygienic absorbent articles, into a "V" or "U" shape in a first longitudinal portion and in a second longitudinal portion according to a longitudinal folding line parallel to a feeding line of the continuous web, said folding apparatus comprising:

a folding section comprising:

an infeed section, at which the continuous web is not folded, and an outfeed section, positioned downstream of the infeed section according to a web feeding direction, at which the continuous web is folded into the "V" or "U" shape and has the first longitudinal portion and the second longitudinal portion set at an angle to each other;

a first suction belt for feeding the continuous web comprising at least one first stretch movable in a first feeding direction for feeding a first edge of the continuous web and dragging the first longitudinal portion of the continuous web;

a second suction belt for feeding the continuous web comprising at least one second stretch movable in a second feeding direction for feeding a second edge and dragging the second longitudinal portion of the continuous web, said first and second suction belts having belt positions on opposite sides of a lying plane of the folding line orthogonal to a lying plane of the continuous web upstream of the folding section;

an adjusting system configured for adjusting relative edge positions of the longitudinal edges of the continuous web once the continuous web has been folded, said adjusting system comprising:

a first sensor positioned downstream of the folding section and configured for checking the relative edge positions once the continuous web has been folded, a first actuator operatively connected to said first suction belt and/or said second suction belt, and a computerized control unit in communication with the first sensor and with the first actuator;

wherein the belt positions of said first suction belt and/or said second suction belt are adjustable and said adjusting system is configured to adjust, using feedback and via the first actuator, at least one of the belt positions of said first suction belt and/or of said second suction belt depending on a first information sent by the first sensor to the computerized control unit.

2. The folding apparatus according to claim 1, wherein the adjusting system further comprises a second sensor positioned upstream of the folding section, in communication with the computerized unit and configured for checking at least one of the edge positions of said longitudinal edges of the continuous web prior to the continuous web being folded and sending a second information to the computerized control unit.

3. The folding apparatus according to claim 2, wherein the adjusting system adjusts, using feedback and via the first actuator, the belt positions of said first and second suction belts depending on the second information sent by the second sensor to the computerized control unit.

4. The folding apparatus according to claim 1, wherein the adjusting system further comprises a suspension element configured for counterbalancing a weight of at least part of the folding section.

5. The folding apparatus according to claim 4, wherein the suspension element comprises a spring.

6. The folding apparatus according to claim 1, wherein the folding section further comprises a contact unit for the continuous web extending along the feeding line of the continuous web and defining, at least partially, the folding line, said contact unit lying in the lying plane of the folding line.

7. The folding apparatus according to claim 6, wherein a position of said contact unit is adjustable and said adjusting system comprises a second actuator, operatively connected to the contact unit and in communication with the computerized control unit, for adjusting using feedback the position of said contact unit depending on at least the first information.

8. The folding apparatus according to claim 6, wherein the adjusting system further comprises a second sensor positioned upstream of the folding section, in communication with the computerized unit and configured for checking at least one of the edge positions of said longitudinal edges of the continuous web prior to the continuous web being folded and sending a second information to the computerized control unit, wherein a position of said contact unit is adjustable and said adjusting system comprises a second actuator, operatively connected to the contact unit and in communication with the computerized control unit, for adjusting using feedback the position of said contact unit depending on at least the second information.

9. The folding apparatus according to claim 6, wherein said contact unit comprises a third movable belt, said third movable belt operating in conjunction with said first suction belt and said second suction belt during folding of the continuous web.

10. The folding apparatus according to claim 1, wherein the folding section further comprises a first guide and a second guide, which are located on opposite sides of the lying plane of the folding line and respectively have a first sliding surface for the continuous web and a second sliding surface for the continuous web.

11. The folding apparatus according to claim 10, wherein the first sliding surface of the first guide and the second sliding surface of the second guide extend in a helical fashion and extend along said feeding line.

12. The folding apparatus according to claim 10, wherein, at the infeed section, the first sliding surface of the first guide and the second sliding surface of the second guide are substantially coplanar with the lying plane of the continuous web upstream of the folding section.

13. The folding apparatus according to claim 10, wherein, at the outfeed section, the first sliding surface of the first guide and the second sliding surface of the second guide are transverse to the lying plane of the continuous web upstream of the folding section and at least partly converging in the feeding direction of the continuous web.

14. The folding apparatus according to claim 10, wherein positions of the first guide and/or the second guide are adjustable and said adjusting system further comprises a third actuator, operatively connected to said first guide and/or to said second guide and in communication with the computerized control unit, for adjusting, using feedback, the positions of said first guide and/or second guide depending on the first information.

15. The folding apparatus according to claim 10, wherein the adjusting system further comprises a second sensor positioned upstream of the folding section, in communication with the computerized unit and configured for checking at least one of the edge positions of said longitudinal edges of the continuous web prior to the continuous web being folded and sending a second information to the computerized control unit, and wherein the positions of the first guide and the second guide are adjustable and said adjusting system comprises at least one third actuator, operatively connected to said first guide and/or to said second guide and in communication with the computerized control unit, for adjusting using feedback the positions of said first guide and/or second guide depending on said second information.

16. A folding method for folding a continuous web, being fed in a plant for production of hygienic absorbent articles, into a "V" or "U" shape in a first longitudinal portion and in a second longitudinal portion according to a longitudinal folding line parallel to a feeding line of the continuous web, the method comprising, in sequence, the steps of:

preparing a folding section comprising an infeed section, where the continuous web is not folded, an outfeed section, positioned downstream of the infeed section according to a continuous web feeding direction, where the continuous web is folded into the "V" or "U" shape and has the first longitudinal portion and the second longitudinal portion set at an angle to each other; said section also comprising at least one first suction belt and one second suction belt, both with adjustable belt positions and configured for feeding, respectively, the first longitudinal portion and the second longitudinal portion of the continuous web;

feeding said continuous web along the feeding line according to the feeding direction of the continuous web;

first detecting edge positions of a first edge and of a second edge of the unfolded continuous web upstream of the folding section according to the feeding direction of the continuous web;

folding the continuous web through the folding section;

second detecting the edge positions of the first edge and of the second edge of the folded continuous web downstream of the folding section according to the feeding direction of the continuous web;

adjusting, using feedback, the belt positions of the first suction belt and of the second suction belt depending on results of said first detecting and said second detecting.

* * * * *